United States Patent [19]

Bauer

[11] 3,938,940

[45] Feb. 17, 1976

[54] PRIMARY CONTROL AND IGNITION SYSTEM FOR OIL BURNERS

[75] Inventor: Frederick T. Bauer, Holland, Mich.

[73] Assignee: Robertshaw Controls Company, Richmond, Va.

[22] Filed: Jan. 9, 1975

[21] Appl. No.: 539,914

[52] U.S. Cl. ..... 431/79; 313/231.3; 317/96

[51] Int. Cl.[2] ..... F23N 5/08

[58] Field of Search ..... 431/78, 80, 79, 72; 313/231.3; 317/79, 96, 4

[56] References Cited

UNITED STATES PATENTS

| | | | |
|---|---|---|---|
| 3,666,982 | 5/1972 | Wiegand | 313/213.3 X |
| 3,829,276 | 8/1974 | Lenski et al. | 431/79 X |
| 3,892,981 | 7/1975 | Bauer | 431/78 X |

*Primary Examiner*—Edward G. Favors

*Attorney, Agent, or Firm*—Malcolm R. McKinnon

[57] ABSTRACT

A solid state primary control and ignition system for oil burners, the system including burner control means, an isolated low voltage control circuit, plasma generator means, combustion initiation means and combustion sensing means, and being effective to provide improved intermittent ignition and improved control for initiating and supervising the combustion of fuel oil in furnaces.

40 Claims, 11 Drawing Figures

PRIMARY CONTROL AND IGNITION SYSTEM FOR OIL BURNERS

BRIEF SUMMARY OF THE INVENTION

This invention relates to oil burner control and ignition systems and, more particularly, to an improved solid state oil burner primary control and ignition system adapted for use with an electric motor powered oil burner.

Heretofore, primary controls have been utilized to control and supervise oil burners in furnaces, such primary controls controlling the furnace burner in response to a low voltage separate thermostat, usually located in the living space of a dwelling or other building, and supervising the furnace burner to insure safe combustion in the furnace's combustion chamber and shutting the burner off if an unsafe condition occurs. Heretofore, conventional high voltage transformers have also been utilized in the oil heating industry for the purpose of producing high energy sparks between electrodes effective to initiate combustion of fuel oil emanating from the furnace burner. Such conventional high voltage transformers are relatively large, heavy and expensive and, because of the operation thereof for a predetermined period of time regardless of whether combustion has occurred or not, cause relatively high burner vestibule temperatures to be created. Prior ignition transformers of the indicated character also require a relatively high electrical load which must be carried by the aforementioned primary control thereby reducing the control reliability and also reducing the ambient temperature ratings thereof. In addition, the noise created by the operation of prior ignition transformers for a predetermined time period which is not correlated with actual ignition and combustion of the oil, and the electrical energy required for the operation thereof create operational and economic disadvantages inimical to the best interests of the users thereof.

Moreover, with respect to economy and reliability, due to the declining availability and increasing cost of copper and transformer steel, transformer manufacturers have been forced to increase the selling price of their transformers and also to reduce the manufacturing cost so that they may maintain a profit. Since the manufacturing techniques involved in making transformers are straightforward and comparatively standardized, manufacturing costs are usually reduced by reducing the amount and quality of the materials used to make a transformer. Such reduction in quantity and/or quality of copper and steel causes the transformer to operate at lower efficiency. Lower efficiency operation causes an increase of heat generated within the transformer which then directly reduces the reliability and life span of the transformer. Since the transformer market is basically a captive market, the low efficiency, short-lived transformer is profitable to the manufacturers, but uneconomical for the users, considering replacement and service costs.

With respect to the problems of continuous ignition for a predetermined period of time which is not correlated with actual ignition or combustion, and the problems of bulk and weight, heretofore, it has been very difficult for control manufacturers to economically design a primary control that will synchronize a transformer to cause ignition only during a pre-combustion period, and then stop ignition after combustion has occurred. The cost factor of making such a control outweighs the practical advantages gained, such as longer life for the transformer and for the discharge electrodes, reduced power consumption for the user, reduced radio frequency interference and other advantages. Consequently, the use of a conventional transformer includes the above disadvantages as a matter of general economic necessity.

Moreover, because of the bulk and weight of the ignition transformers, burner and furnace manufacturers are limited in their creative design ability with respect to the mounting of the transformer. This is no small disadvantage when manufacturers are forced to create smaller furnaces for a specific purpose such as mobile homes or campers.

An object of the present invention is to overcome disadvantages in prior primary control and ignition systems of the indicated character and to provide an improved solid state oil burner primary control and ignition system adapted for use with oil burners powered by an elecric motor.

Another object of the invention is to provide an improved oil burner primary control and ignition system which is adapted to provide intermittent ignition, time safety shutdown, motor starting capability and automatic restart in the event of combustion failure.

Another object of the present invention is to provide an improved primary control and ignition system incorporating improved control and ignition circuitry which provides improved furnace burner control, supervision and ignition.

Another object of the present invention is to provide an improved solid state primary control and ignition system which incorporates improved means for producing an intermittent high frequency and high energy ionization arc effective to initiate combustion of fuel oil in a minimum of time thereby increasing user economy by reducing power consumption and increasing transformer and electrode life, and also reducing radio frequency interference.

Another object of the invention is to provide an improved solid state primary control and ignition system which is readily adaptable to meet the control and ignition requirements of various types of oil burners.

Another object of the invention is to provide an improved solid state primary control and ignition system which facilitates a substantial reduction in the size, weight and cost of the ignition transformer incorporated therein without reducing the quality and/or efficiency of the ignition transformer.

Another object of the invention is to provide an improved solid state primary control and ignition system which reduces burner vestibule temperatures, reduces the electrical load carried by the control circuitry incorporated therein and which increases control reliability and the ambient temperature ratings thereof.

Another object of the present invention is to provide an improved solid state primary control and ignition system incorporating improved means for providing extended ignition for a predetermined period of time after proof of flame has been established so as to guarantee oil combustion.

Another object of the invention is to provide an improved primary control and ignition system which permits versatility with respect to the mounting of the components thereof.

Another object of the invention is to provide an improved solid state primary control and ignition system having increased tolerance to excessively gapped and fouled electrodes.

Still another object of the invention is to provide an improved solid state primary control and ignition system which is economical to manufacture and assemble, durable, efficient and extremely reliable in operation.

The above as well as other objects and advantages of the present invention will become apparent from the following description, the appended claims and the accompanying drawings.

DETAILED DESCRIPTION

Figure 1:
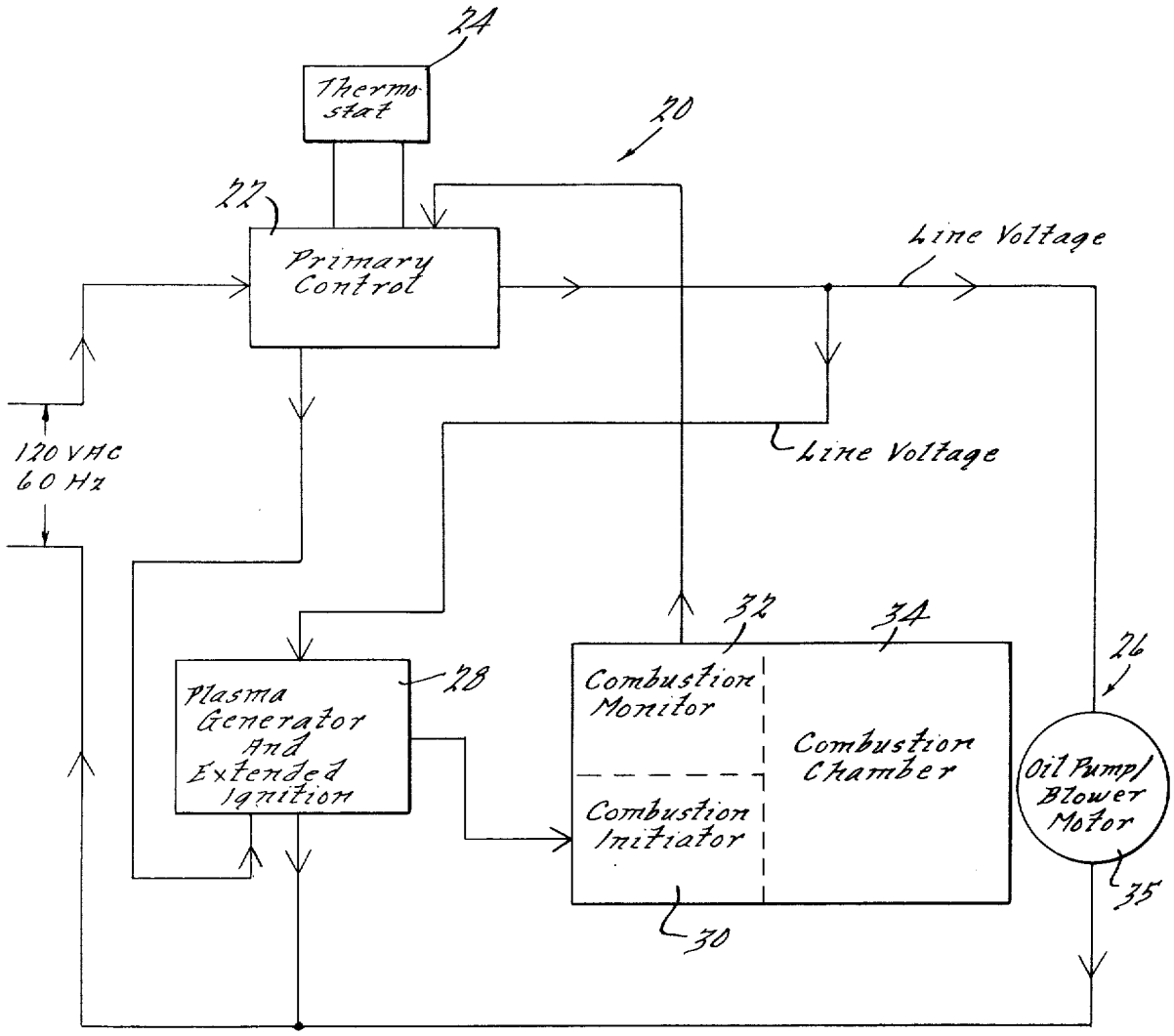
FIG. 1 is a schematic block diagram of a primary control and ignition system embodying the present invention.

Referring to the drawings, and more particularly to FIG. 1 thereof, a schematic block diagram of a primary control and ignition system, generally designated 20, embodying the present invention is illustrated therein. As shown in FIG. 1, the system 20 is comprised of a primary control circuit, generally designated 22, adapted to be connected to a conventional source of line voltage alternating current, such as conventional nominal 120 volt alternating current. The system 20 also includes a low voltage thermostat circuit, generally designated 24, an oil pump/blower motor circuit, generally designated 26, a plasma generator and extended ignition circuit, generally designated 28, a combustion initiator circuit, generally designated 30 and a combustion monitor circuit, generally designated 32, the above described circuitry all being electrically connected by suitable conductors as illustrated in the drawings and as will be described hereinafter in greater detail.

The system 20 is adapted to provide control, supervision, intermittent ignition, extended ignition, timed safety shutdown, motor starting capability and automatic restart in the event of combustion failure.

In general, the control system illustrated in FIG. 1 operates in the following manner. Line voltage is supplied to the primary control and ignition system 20 through normally closed safety switch contacts embodied in the primary control circuit 22. (The components of all of the aforementioned circuits 22, 24, 26, 28, 30 and 32 will be described hereinafter in greater detail). When the room temperature declines below the set point of the thermostat 24, the thermostat contacts close. Closure of the thermostat contacts activates the primary control circuit 22, and activation of the primary control circuit 22 causes line voltage to be applied to the oil pump/blower motor circuit 26 and the plasma generator and extended ignition circuit 28. At the same time, safety lockout timing means embodied within the primary control circuit 22 is initiated. The safety lockout means causes the primary transformer current in the primary control circuit 22 to increase from an idle level to a working level. Since both the plasma generator and ignition circuit 28 and the oil pump/blower motor circuit 26 are connected to line voltage they are activated. Upon activation, the plasma generator and extended ignition circuit 28 initiates an ionic discharge across electrodes located in approximation to the combustion chamber 34. Oil particles sprayed by the oil pump 35 are caused to ignite and combustion is obtained. The combustion monitor circuit 32, sensing combustion, inhibits the safety timing function of the safety timing means embodied in the primary control circuit 22, and the inhibition of the safety timing means causes primary current in the primary control circuit 22 to return to its idle value.

Sensing means within the plasma generator and extended ignition circuit 28 detects this return to idle of the primary current of the primary control circuit 22, and begins a timing cycle to provide extended ignition to guarantee combustion. At the end of such timing cycle, the plasma generator and extended ignition circuit 28 inhibits its ionic discharge and assumes a standby state. In the event of combustion failure, the combustion monitor circuit 32 causes immediate activation of the safety timing embodied in the primary control circuit 24, which in turn immediately reactivates the plasma generator and extended ignition circuit 28, causing again, ionic discharge in an attempt to re-establish combustion. If combustion is re-established the above logic is repeated. If not, safety timing concludes and all voltages are removed from all system components until the safety switch means is manually reactivated.

During normal operation, after combustion is achieved, and room temperature rises above the thermostat set point, the thermostat contacts open. Upon opening of the thermostat contacts, line voltage is removed from the oil pump/blower motor circuit 26 and the plasma generator and extended ignition circuit 28, and the system assumes a standby state until the next thermostat command.

Figure 2:
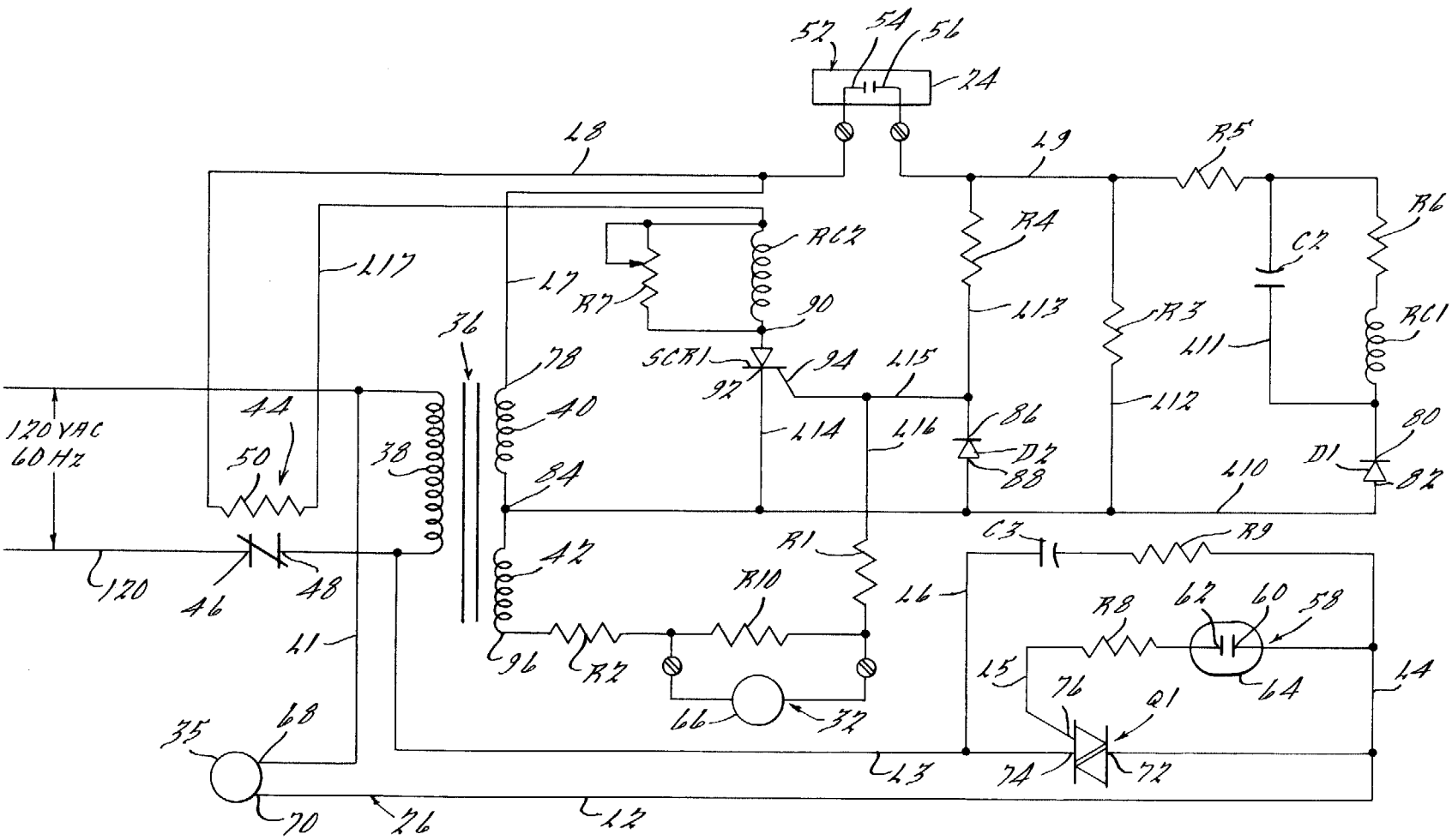
FIG. 2 is a schematic diagram illustrating the circuitry for the thermostat and primary control blocks illustrated in FIG. 1.

Referring in greater detail to the various circuits hereinabove mentioned, as shown in FIG. 2, the primary control circuit 22 is comprised of a step down transformer 36 having a primary winding 38 and secondary windings 40 and 42, the primary winding 38 being adapted to be connected to a conventional source of nominal 120 volt alternating current while, in the embodiment of the invention illustrated, each of the secondary windings 40 and 43 of the isolated step-down transformer preferably has a potential of approximately 8 volts AC. The primary control circuit 22 also includes a line voltage safety switch, generally designated 44, including normally closed contacts 46 and 48 and a heater coil 50; a conventional thermostat generally designated 52 having contacts 54 and 56; a reed switch, generally designated 58, having contacts 60 and 62 and independent, concentrically wound coils RC1 and RC2, the contacts 60 and 62 being enclosed within a hermetically sealed glass envelope 64 while the coils RC1 and RC2 are concentrically wound therearound; a triac Q1 and a silicon controlled rectifier SCR1. The primary control circuit 22 also includes a cadmium sulfide flame detector 66, resistors R1, R2, R3, R4, R5, R6, R8, R9 and R10; capacitors C2 and C3; a potentiometer R7 and diodes D1 and D2. As shown in the drawings, the primary control circuit 22 is connected to and adapted to control and supervise the oil pump/- blower motor 35. The terminal 68 of the oil pump/-blower motor 35 is connected to the source of power by the lead L1 while the terminal 70 of the oil pump/-blower motor 35 is connected to the terminal 72 of the triac Q1 by the lead L2, the terminal 74 of the triac Q1 being connected to the source of power by the lead L2. The contact 60 of the reed switch 58 is connected by the lead L4 to the lead L2 while the contact 62 is connected to the gate 76 of the triac Q1 through the resistor R8 by the lead L5, the resistor R9 and capacitor C3 being connected across the leads L2 and L3 by the leads L4 and L6 to protect the triac Q1.

The normally closed contacts 46 and 48 of the safety switch 44 are connected to and adapted to make and break the high voltage lead 120 connected to the primary winding 38 of the transformer 36.

The terminal 78 of the secondary winding 40 is connected to the heater coil 50 of the safety switch 44 and to the contact 54 of the thermostat 52 by the leads L7 and L8, the contact 56 of the thermostat 52 being connected by the lead L9 through the resistors R5 and R6 and the coil RC1, to the terminal 80 of the diode D1. The terminal 82 of the diode D1 is connected to the center tap 84 of the secondary windings of the transformer 36 by the lead L10. The capacitor C2 is connected across the resistor R6 and the coil RC1 of the reed switch 58 by the lead L11 while the resistor R2 is connected between the leads L9 and L10 by the lead L12 as illustrated in FIG. 2. The contact 56 of the thermostat 52 is also connected to the terminal 86 of the diode D2 by the lead L13 through the resistor R4, the terminal 88 of the diode D2 being connected to the center tap 84 of the transformer 36 by the lead L10. As shown in FIG. 2, the heater coil 50 of the safety switch 44 is connected to the terminal 90 of the silicon controlled rectifier SCR1 through the coil RC2 of the reed switch 58 by the lead L7, the potentiometer R7 being connected across the coil R2. The terminal 92 of the silicon controlled rectifier SCR1 is connected to the center tap of the transformer 36 by the leads L14 and L10 while the gate 94 of the rectifier SCR1 is connected to the terminal 86 of the diode D2 by the lead L15 and to the terminal 96 of the secondary winding 42 of the transformer 36 by the lead L16 through the resistor R1, the cadmium sulfide flame detector 66 and the resistor R2, the resistor R10 being connected across the flame detector 66 and functioning to stabilize the silicon controlled rectifier SCR1.

The safety switch 44 may be of the type disclosed in the U.S. application of William J. Russell, Ser. No. 421,525, filed Dec. 14, 1973 and assigned to the assignee of the present invention, in which at least one of the contacts 46 or 48 is carried by a bimetallic member and in which energization of the heater coil 50 for a predetermined period of time is effective to open the contacts 46 and 48 by heating the bimetallic member, as for example for a period of 15 seconds. Opening of the contacts 46 and 48 breaks the line voltage to the primary control circuit 22, it being preferred that the contacts 46 and 48 open approximately 15 seconds after attempted ignition of the oil with 120 VAC nominal line voltage input. Thus, if combustion does not occur within such predetermined time period, the contacts 46 and 48 open thereby deactivating all circuits for safety shutdown purposes. It will also be understood that a bimetallic switch of the type hereinabove mentioned is trip-free and may be reset by a push button after a cool down period has elapsed.

The rectifier SCR1 is a conventional silicon controlled rectifier and may, for example, carry a rating of approximately four amperes. The thermostat 52 may be of any desired or conventional construction while the reed switch 58 is preferably of the type comprised of the pair of contacts 60 and 62 carried by reeds hermetically sealed within the glass envelope 64. The reed switch also includes the electrically insulated, independently wound concentric coils RC1 and RC2, the magnetic fluxes of such coils being additive when in phase. The reed switch 58 preferably has a very large differential between pull-in and drop-out ampere turns or coil power. By way of example, the reeds preferably will pull in at about 60 ampere turns, but will not drop out until below 20 ampere turns, a ratio of approximately 3 to 1. In the embodiment of the invention illustrated, the maximum power to the coil RC1 is well below that required to pull-in the reed switch and close the contacts 60 and 62. The power is, however, enough to hold the reed switch contacts 60 and 62 closed once pull-in has been established, due to the very large differential. The reed switch coil RC2, on the other hand, has sufficient power when combined with RC1 to pull in the reed switch. Since reed switches are very fast they are capable of following an alternating current voltage to open or close 60 or 120 times per second. To avoid this opening and closing and the associated wear, the diode D1 and the capacitor C2 are provided. The diode D1 is preferably a 200 milliampere diode which supplies half wave rectified current to the capacitor C2 to establish a DC supply for the reed switch coil RC1. The capacitor C2 is preferably a 47 microfarad 15 volt DC capacitor. The diode D1 and the capacitor C2 function to form a DC supply for the holding coil RC1 so that flux is always present on the coil RC1 when the thermostat calls for heat. This flux is very small however. With such a construction and since relatively small current passes through the contacts 60 and 62, such contacts are very reliable over a relatively long life.

The triac Q1 is a bidirectional thyrister which may be gate triggered from a blocking to a conducting state for either polarity of applied voltage, and is preferably mounted to isolate the other components of the system from the heat generated by the triac Q1. The resistors R1 and R2 are preferably carbon resistors having ratings of 150 ohms and 560 ohms, respectively, one-half watt, the purpose of the resistor R1 being to prevent the accidental destruction of the diode D1, transformer 36 or silicon controlled rectifier SCR1 by a serviceman in the field. In this connection the resistors R1, R2, R5, R9 and R10, the diode D2 and the capacitor C3 are all provided in the system for the purpose of protecting other components and to protect against erroneous wiring in the field. The resistors R1, R2, R5, R9 and R10, the diode D2 and the capacitor C3 are thus not essential to the basic circuit performance.

Assuming a basic knowledge of the triac Q1, the silicon controlled rectifier SCR1, and the cadmium sulfide flame detector 66, the primary control circuit 22 operates in the following manner in a typical thermostat cycle. It should be noted initially that whenever the reed contacts 60 and 62 are closed, current will flow from the source of electric power through the lead L1, the oil pump/blower motor 35, the lead L2, the contacts 60 and 62 and the resistor R8, to the gate of the triac Q1 and the lead L3. When the gate of the triac Q1 is energized the full motor current will then pass through the triac Q1. This starts the oil pump/blower motor 35 and has the same effect as closing a set of relay contacts between the lead L2 and the lead L3.

Whenever the thermostat contacts 54 and 56 close, a continuous holding flux is established in the coil RC1 by the DC supply network comprised of the diode D1 and the capacitor C2. Current also flows through the resistor R4 to the gate 94 of the silicon controlled rectifier SCR1. If the cadmium sulfide flame detector 66 registors darkness, no current can be shunted away from the gate 94 of the silicon controlled rectifier SCR1 and SCR1 will conduct. When SCR1 conducts, current also passes through the pull-in coil RC2 of the reed switch 58 and the heater 50 of the safety switch 44. With a flux established in the coil RC2 and the coil RC1, the reed switch contacts 60 and 62 will pull-in and the triac Q1 will start the oil pump/blower motor 35. If the cadmium sulfide flame detector 66 does not register flame, the silicon controlled rectifier SCR1 will continue to conduct and the safety switch 44 will open the contacts 46 and 48 due to the heating action of the heater 50 as previously described. It is preferred that the contacts 46 and 48 open and lock out after approximately fifteen seconds. If the cadmium sulfide flame detector registors flame, then the flame detector 66 decreases in resistance and shunts current away from the gate 94 of the rectifier SCR1. SCR1 will no longer conduct, the heating coil 50 of the safety switch will be deenergized but the coil RC1 will continue to hold in the reed relay contacts 60 and 62. If the cadmium cell 66 registers flame and for some reason the flame should go out during the thermostat cycle, the rectifier SCR1 will again conduct and the heating coil 50 will be energized so as to open the contacts 46 and 48 into a lockout condition. When the thermostatic conditions are satisfied and the contacts 54 and 56 thereof open, the coil RC1 is deenergized thereby opening the contacts 60 and 62 and also deenergizing the triac Q1. No current is then available through the resistor R4 to energize SCR1 even though the cadmium cell 66 registers no flame. It should also be understood that the same cycle would occur if the thermostat were connected to line voltage and placed in one leg of the transformer primary coil.

The plasma generator and extended ignition circuit 28 may be divided into two distinct functional sections. One, the "plasma generator" section, is responsible for generating the ionic discharge which initiates combustion. The other section comprises an "SCR follower" and acts as a command circuit to control the state of the "plasma generator" section.

Figure 4:
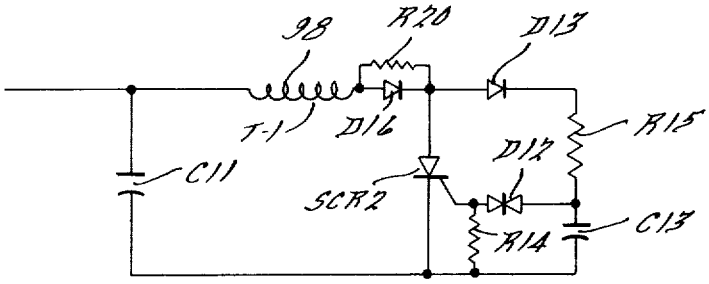
FIG. 4 is a schematic diagram illustrating the plasma generator portion of the circuitry illustrated in FIG. 3.
Figure 3:
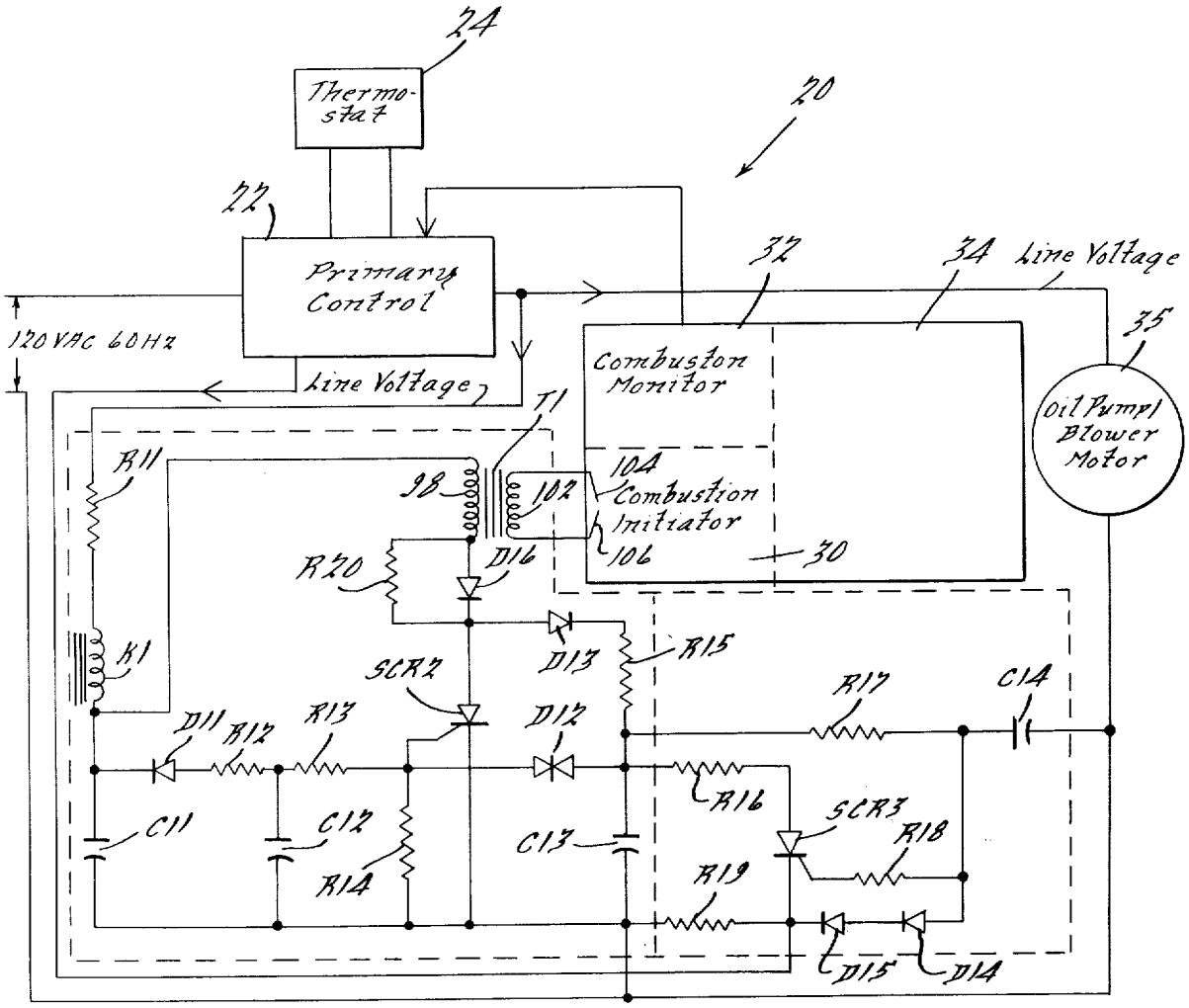
FIG. 3 is a schematic diagram illustrating the circuitry for the combustion initiator, combustion monitor and plasma generator and extended ignition blocks illustrated in FIG. 1.

The plasma generator circuit 28, illustrated in FIG. 3, may also be divided into three sections illustrated in FIG. 4 for ease of description. These sections comprise (1) a trigger made up of resistors R14 and R15, a diode D13, a capacitor C13 and a trigger diode D12 connected across a silicon controlled rectifier SCR2; (2) an "electronic brake" comprising a diode D11, a capacitor C12 and resistors R12, R13, and R14 connected in parallel to the capacitor C11; and, (3) the plasma generator proper comprising the silicon controlled rectifier SCR2, a transformer T1, a capacitor C11, a diode D16 and a resistor R20.

Alternating voltage applied to the circuit 28 causes the capacitor C11 to charge to some value of voltage (positive or negative), the rate of charge being determined by the inductance of a choke K1, its DC resistance, and the resistance of resistor R11. During the negative swing of the line voltage, the capacitor C11 charges to the magnitude of the line voltage in a sinesoidal manner. As the line voltage crosses through zero and begins its positive rise, the capacitor C11 charges toward a positive voltage. Since the silicon controlled rectifier SCR2, through the primary winding 98 of the transformer T1, is parallel to the capacitor C11, the silicon controlled rectifier SCR2 cannot conduct during the negative half cycle of the voltage. When the capacitor C11 charges toward a positive voltage this voltage occurs across the silicon controlled rectifier SCR2 anode to cathode.

This same voltage is placed across the resistor R15 and the capacitor C13. Consequently, the capacitor C13 begins to charge to a positive voltage at a rate determined by its capacitance and the resistance of the resistor R15. When the voltage across the capacitor C13 reaches a magnitude of from 28 to 36 volts, it causes the trigger diode D12 to break down, thus discharging the capacitor C13 through the resistor R14 and causing the silicon controlled rectifier SCR2 to turn on through its gate 100. The diode D13 prevents any negative voltage being applied to this or connected circuits.

Figure 5:
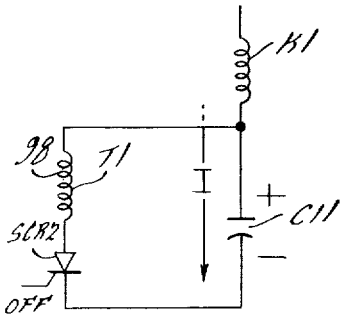
FIGS. 5, 6, 7, 8, 9, 10 and 11 are schematic circuit diagrams illustrating the operation of the circuitry of FIG. 3.
Figure 6:
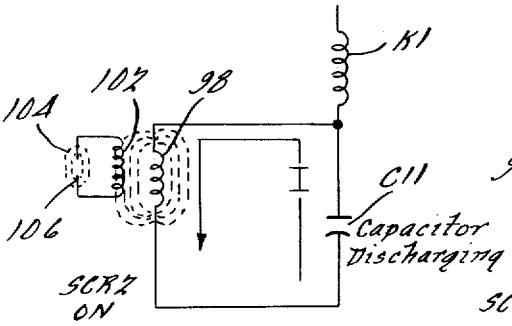
Figure 7:
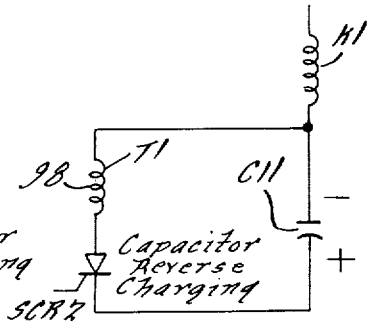

As shown in FIGS. 5, 6 and 7, when the silicon controlled rectifier SCR2 turns on it changes from an open circuit to essentially a short circuit. The high voltage transformer T1 primary winding 98 is then placed directly across the capacitor C11. The low impedance primary winding 98 of the transformer T1 when suddenly placed across the capacitor C11 causes the capacitor C11 to instantaneously discharge. The impedance of the choke K1 momentarily resists the line voltage from maintaining the charge on the capacitor C11. The capacitor C11 then discharges through the primary winding 98 of the transformer T1 and the silicon controlled rectifier SCR2. This discharge causes the transformer T1 to build a magnetic field which cuts its secondary winding 102, generating a high voltage ionization at ignition electrodes 104 and 106. As the discharge energy of the capacitor C11 diminishes the magnetic field of the transformer T1 collapses, forcing current to continue through the silicon controlled rectifier SCR2 in the same direction and causing the capacitor C11 to be charged to the opposite polarity of voltage.

Negative voltage is reflected across the silicon controlled rectifier SCR2 anode to cathode. Negative voltage is also developed from gate to cathode through the aforementioned electric brake section comprising the diode D11, the resistor R12, the filter C12, the resistor R13 and the resistor R14.

Figure 8:
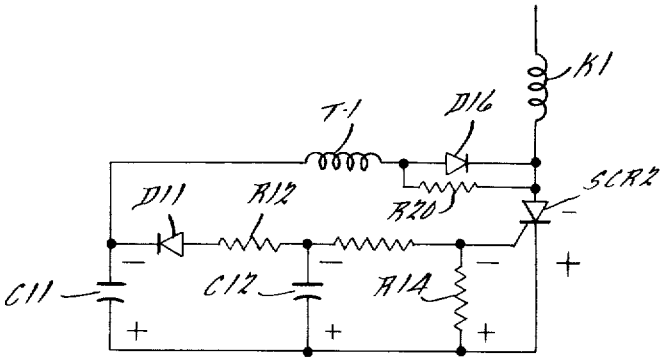
Figure 9:
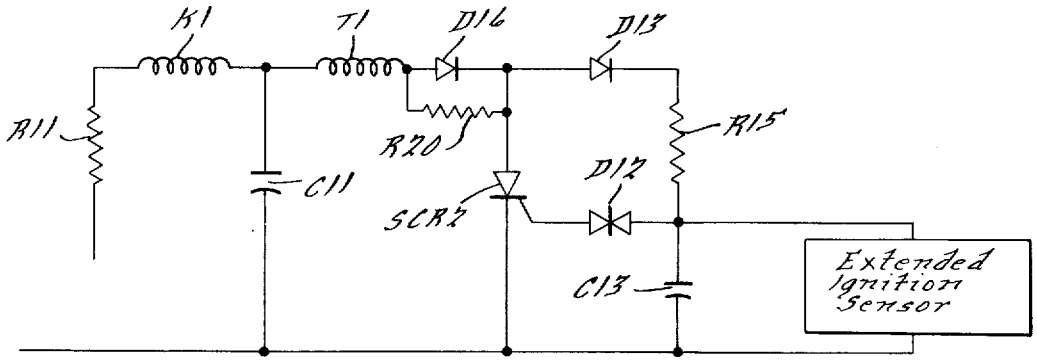
Figure 10:
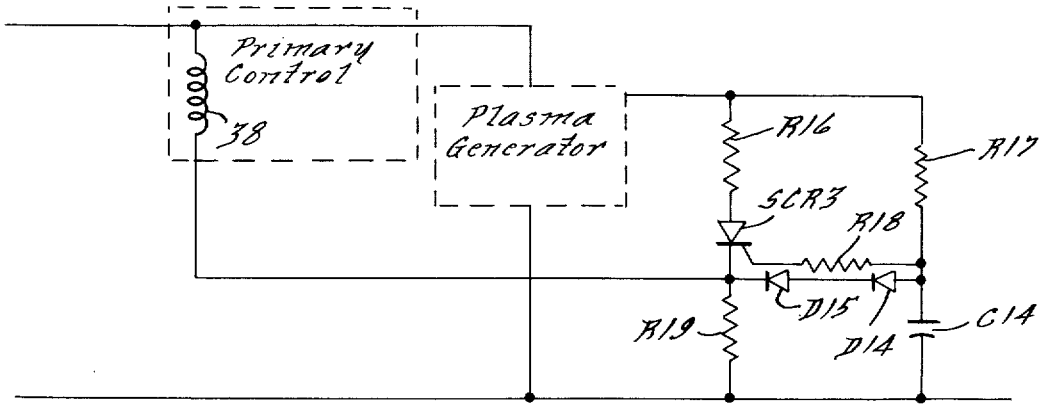
Figure 11:
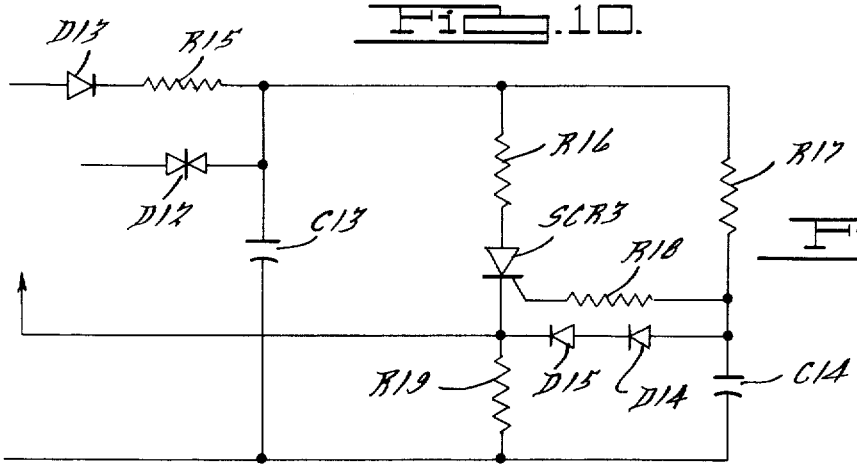

As illustrated in FIG. 8, this negative voltage applied from anode to cathode and maintained from gate to cathode causes the silicon controlled recitifier SCR2 to instantly turn off and again to assume an open circuit condition. When the field of the transformer T1 collapses, the energy for the first microsecond creates an approximate 1,200 volt negative spike. Since the silicon controlled rectifier SCR2 is already in conduction and is essentially a slow recovery device (with respect to one microsecond) a very large surge current could be forced through the silicon controlled recitifier SCR2, and such a surge could result in the silicon controlled rectifier SCR2 dissipating power in the form of heat thereby causing a heat rise which would reduce the capabilities of the silicon controlled recitifier SCR2 by narrowing its operating parameters. In accordance with the present invention, such a situation is prevented from occurring by the parallel combination of the diode D16 and the resistor R20. The diode D16 is a fast recovery diode which has an approximate 200 nanosecond turn off time. Therefore, when the transformer T1 causes the negative voltage to be developed, the diode D16 "turns off" immediately forcing its parallel resistor R20 to absorb the majority of the negative spike thus relieving the silicon controlled rectifier SCR2 and the capacitor C11 from the unnecessary surge of the first nanosecond of the turn off cycle. This action limits the negative voltage applied to the silicon controlled rectifier SCR2 to about 500 volts. It should be understood that once gated, the silicon controlled rectifier SCR2 is very difficult to turn off reliably, and yet the silicon controlled rectifier SCR2 must be turned off to achieve a multiplicity of ignition pulses during the short time of one-half of the AC voltage waveform. Since only a very small increment of the positive half cycle of applied voltage was consumed during the generation of this pulse, the capacitor C11 again assumes a positive charge, beginning however, from a negative voltage. The above process repeats itself approximately forty times during each positive half cycle of the applied line voltage. This results in what appears to be a steady ionization arc across the electrodes 104 and 106 of the burner. Since ignition is generated at the same time the oil burner motor is actuated, oil is sprayed through the ionizing arc into the combustion chamber 34. It will also be understood that oil requires much energy to ignite, and that, additionally, the ion path directly between the electrodes 104 and 106 should not be in the oil spray itself or malfunction could result. Consequently, these rapid multiple discharges are preferably "blown" into the oil spray by the blower section of the oil pump/blower motor 35.

The combustion chamber 34 is monitored by the cadmium sulfide flame detector 66 illustrated in FIG. 2. When sufficient light is generated by the combustion process the resistance of the cadmium sulfide flame detector 66 drops from a very high value to a very low value.

This, as previously mentioned, causes safety timing in the primary control circuit 22 to cease, consequently permitting the primary transformer current in the primary control circuit 22 to return to its idle value. Such current change is sensed by the extended ignition section which permits the plasma generator section to operate for a few additional seconds after combustion is achieved and then forces the plasma generator section into a standby condition.

The extended ignition section of the circuit 28 uses only one silicon controlled rectifier, three diodes, four resistors, and one capacitor to perform three separate and distinct functions. These functions include switching the plasma generator section, previously described, from an active state to standby, and also acting as a timer under two sets of operating conditions. The first condition is as an ignition extender after combustion has been proven and to act as a guarantee of combustion. The other condition is to provide timed ignition upon application of voltage to the system. This is an additional safety feature to protect against a shorted triac in the primary control circuit, or a welded contact of a relay in a substituted control, that would allow oil to be pumped without thermostat contact closure. The timing period of such ignition cycle is approximately twice as long as the extended ignition timing cycle, such safety feature preventing uncontrolled combustion. It will be understood that if the oil pump were to operate without ignition, the heating chamber could become saturated or even filled with oil. If at this point, as may happen, an inexperienced serviceman or homeowner were to attempt to correct the original malfunction and allow combustion to be established, an uncontrollable fire could result. The minimum result could be damage to the furnace; the worst, loss of the dwelling. With the safety feature above mentioned, whenever power is applied to the system, ignition occurs to establish combustion. When the furnace bonnet reaches cutout temperature, the bonnet cutout switch (not shown) removes power from the system. Upon cool-down, the cutout switch reapplies power and combustion is re-established. This results in higher than average dwelling temperature (about 90° F), but prevents a catastrophe and provides a warning to the dwelling occupant to notify a serviceman for repair.

In addition, the third function that the extended ignition system section performs is automatic line voltage compensation. The extended ignition section will compensate itself automatically to line voltage variations below 90 VAC to above 140 VAC. Additionally, the extended ignition section is not sensitive to the wave shape of the current being sensed. The extended ignition section will operate equally well with a sine wave or a distorted form of sine wave caused by unequal loading or transformer saturation.

As is well known to those skilled in the art, fuel oil in cold weather is much more difficult to ignite than in warm weather, and the extended ignition circuit automatically causes the extended timing cycle to increase as ambient temperature decreases. The extended ignition section is connected in parallel to the capacitor C13 of the plasma generator section and derives its anode and gate voltage through the resistor R15, the maximum amplitude of the voltage being determined by the breakover point of the trigger diode D12.

Assuming that the room thermostat contacts 54 and 56 are open, no heat or ignition is demanded, and consequently the primary control circuit 22 is not supplying line voltage to the plasma generator and extended ignition circuit 28. With the thermostat contacts 54 and 56 open, the primary winding 38 is drawing idle current, that is, there is no load connected to the secondary windings 40 and 42. The current then is primarily inductive and lags the applied line voltage by some angle. This same current flows through the resistor R19 and develops a voltage across R19 in phase with the current of the transformer primary winding 38. Connected in parallel to the resistor R19 is the series combination of the silicon diodes D14 and D15 and the capacitor C14. The cathode of the diode D15 is connected to the resistor R19 and to the anode of the diode D14 to the capacitor C14. The voltage developed across the resistor R19 is AC in nature, going through zero in a positive-negative cycle. The positive going portion of the wave cannot effect any change on the capacitor C14 because of the blocking action of the diodes D14 and D15. However, the negative portion of the wave could place a negative charge on capacitor C14 if the voltage developed across the resisting R19 exceeded 0.44 amps, which, of course, is many times higher than the idle current of the transformer 36. Therefore, in the above condition of the circuit operation description, capacitor C14 is unaffected by the idle current of the transformer 36.

Assuming that line voltage is emanating from the primary control circuit 22 and is applied to the plasma generator and extended ignition circuit 28, such line voltage immediately activates the plasma generation section, previously described, to produce ionic discharge at the electrodes 104 and 106. The voltage across capacitor C13 is then applied to the extended ignition section. This voltage is applied to the capacitor C14 through the limiting resistor R14 and causes the capacitor C14 to slowly charge to a positive voltage. The capacitor C14 will then continue to charge until the firing point of the silicon controlled rectifier SCR3 is reached, thereby turning on SCR3. When SCR3 is turned on, its voltage drop plus the voltage drop of the resistor R16 is less than the minimum voltage required to breakover the trigger diode D12, and consequently the plasma generator section will cease to operate. The above described operation is an abnormal condition in that the thermostat contacts 54 and 56 were open, but voltage was applied to the plasma generator and extended ignition circuit 28 and timed ignition was provided. With the foregoing in mind, and assuming the contacts 54 and 56 of the room thermostat are closed, voltage is again applied to the plasma generator and extended ignition circuit 28, and the capacitor C14 begins to charge toward turning on the silicon controlled rectifier SCR3. However, the primary current of the transformer 36 has increased from an idle to a working level, and consequently such change increases the magnitude of the current and causes a phase shift toward the phase of applied line voltage. The primary current and line voltage are thus closer to an in phase condition. The voltage applied to the extended ignition section is thus basically capacitive in nature. That is, the voltage "seen" by the extended ignition section slightly lags the applied line voltage. Therefore, because the voltage developed across the resistor R19 leads the applied voltage, and the voltage at the anode of the silicon controlled recitifier SCR3 lags the applied voltage, there is an approximate 90° phase shift between the anode and the cathode of SCR3. When the transformer 36 is loaded (on safety timing) the voltage across the resistor R19 shifts and is in phase with the voltage being applied to the anode of the silicon controlled rectifier SCR3. This phase shift and the increase in magnitude of voltage developed across the resistor R19 prevent the silicon controlled rectifier SCR3 from firing. Such positive half cycle raises the cathode above the gate voltage presented by the capacitor C14 and the negative half cycle clamps the capacitor C14 to a low positive voltage equal to the voltage across the resistor R19 minus the 1.2 volt diode voltage drop. Consequently, until combustion is proven, the plasma generator section, previously described, will cause ionic discharge in an attempt to initiate combustion because the silicon controlled rectifier SCR3 cannot be turned on. When the combustion monitor 66 in the combustion chamber provides "proof" of combustion to the primary control circuit 22, it again resumes idle primary current because safety timing has ceased. The phase shift and voltage decrease across the resistor R19 allow the capacitor C14 to resume its positive charge, which will, after some time, turn on the silicon controlled rectifier SCR3, which in turn places the plasma generator section in a standby condition. It will be understood that voltage is still applied throughout the heating cycle and that if there is a combustion failure, the safety timing will resume in the primary control circuit 22 and consequently turn off the silicon controlled rectifier SCR3, causing renewed ignition by the plasma generator section.

Voltage compensation is automatically provided because the idle current varies with applied voltage. This establishes a bias at the cathode of the silicon controlled rectifier SCR3. Such bias forces the capacitor C14 to this bias voltage plus the firing voltage of SCR3. Therefore, regardless of the applied line voltage, the silicon controlled rectifier SCR3 will always respond to the phase shift and magnitude change in the same manner.

Typical values for the components in the primary control and ignition system described above are as follows:

| | |
|---|---|
| SCR1 | 4 AMP Silicon Controlled Rectifier |
| SCR2 | C-106 RCA or Equivalent |
| SCR3 | C-103 GE or Equivalent |
| R1 | ½ watt 150 ohm resistor, ± 20% |
| R2 | ½ watt 560 ohm resistor, ± 20% |
| R3 | 5 watt 20 ohm resistor, ± 20%, wirewound |
| R4 | ½ watt 3300 ohm resistor, ± 20% |
| R5 | ½ watt 47 ohm resistor, ± 20% |
| R6 | 1 watt 680 ohm resistor, ± 20%, wirewound |
| R7 | 2 watt 1 ohm potentiometer, ± 20%, wirewound |
| R8 | ½ watt 82 ohm resistor, ± 20% |
| R9 | ½ watt 82 ohm resistor, ± 20% |
| R10 | ½ watt 33000 ohm resistor, ± 20% |
| R11 | 22 watt 15 ohm resistor ± 20% wire wound |
| R12 | 1 watt 6.8 K ohm resistor ± 10% |
| R13 | ½ watt 1K ohm resistor ± 10% |
| R14 | ½ watt 560 ohm resistor ± 10% |
| R15 | ½ watt 22K ohm resistor ± 5% |
| R16 | ½ watt 3.3K ohm resistor ± 10% |
| R17 | ½ watt 150K ohm resistor ± 10% |
| R18 | ½ watt 15K ohm resistor ± 10% |
| R19 | ½ watt 2.7 ohm resistor ± 10% |
| R20 | 1 watt 330 ohm resistor ± 10% wire wound |
| C2 | 47 mfd capacitor 15 VDC |
| C3 | 22 mfd capacitor 200 V Mylar Foil |
| C11 | .33 mfd capacitor 600 VDC extended foil construction |
| C12 | .022 mfd capacitor 200 VDC metal film construction |
| C13 | .022 mfd capacitor 200 VDC metal film construction |
| C14 | 330 mfd capacitor 6 VDC tantalum - Dickson GS series |
| D1 | 200 Ma diode |
| D2 | 200 Ma diode |
| D11 | Diode IN4004 |
| D12 | Diode ST2 |
| D13 | Diode IN4004 |
| D14 | Diode IN4148 |
| D15 | Diode IN4148 |
| D16 | Diode RCA 40892 or Equivalent |
| L1 | Choke, iron core |
| T1 | Transformer high voltage |

It will be understood, however, that these values may be varied depending upon the particular application of the principles of the present invention.

While a preferred embodiment of the invention has been illustrated and described, it will be understood that various changes and modifications may be made without departing from the spirit of the invention.

What is claimed is:

1. In an electrical primary control and ignition system for oil burners, the combination including burner control means adapted to be connected to a main line source of AC current, a low voltage control circuit including burner ignition detection means, means providing a substantially lower voltage than line voltage in said control circuit, means in said low voltage control circuit including solid state means effective to actuate said burner control means, means interfacing between said low voltage control circuit and said burner control means, plasma generating means adapted to be connected to said main line source of AC current, and combustion initiation means operatively connected to said plasma generating means.

2. The combination as set forth in claim 1 including extended ignition means operatively connected to said plasma generating means and effective to maintain energization of said plasma generating means for a predetermined period of time as a function of ignition detected by said ignition detection means.

3. The combination as set forth in claim 1 wherein said control circuit also includes energy conversion means effective to interrupt the flow of current from said main line source of AC current, said ignition detection means also being effective to disable said energy conversion means.

4. The combination as set forth in claim 1, said plasma generating means including a silicon controlled rectifier having an anode, a cathode and a gate, a transformer having a primary winding and a secondary winding, a capacitor, a diode and a resistor, said primary winding and said diode being connected in series with said anode and said cathode, said resistor being connected in parallel with said diode, said capacitor being connected in parallel with said anode and said cathode.

5. The combination as set forth in claim 1, said plasma generating means including trigger means and electronic brake means.

6. The combination as set forth in claim 5, said trigger means including a silicon controlled rectifier having an anode, a cathode and a gate, a pair of resistors, a diode, a capacitor and a trigger diode, one of said resistors, said diode, said capacitor and said trigger diode being connected across said anode and said cathode of said silicon controlled rectifier, the other of said resistors being connected to said gate.

7. The combination as set forth in claim 5, said electronic brake means comprising a pair of capacitors, a diode and a plurality of resistors, said diode, said resistors and one of said capacitors being connected in parallel with the other of said capacitors.

8. The combination as set forth in claim 1 wherein said burner control means includes a triac.

9. The combination as set forth in claim 1 wherein said interfacing means includes a reed switch having normally open contacts.

10. The combination as set forth in claim 1, said interfacing means including a reed switch having a pair of normally open contacts, said control circuit including a coil encompassing said contacts whereby energization of said coil effects closing of said contacts, said control circuit also including a DC supply for said coil.

11. The combination as set forth in claim 1, said combustion initiation means including a transformer having a primary winding and a secondary winding, and a pair of spaced electrodes electrically connected to said secondary winding.

12. The combination as set forth in claim 3, including electrical switch means controlled by said energy conversion means and effective to interrupt the flow of current from said main line source of AC current.

13. The combination as set forth in claim 1, said ignition detection means being in the form of a light dependent resistor.

14. The combination as set forth in claim 4, including choke means electrically connected in series with said capacitor.

15. The combination as set forth in claim 2, said extended ignition means including a silicon controlled rectifier and a capacitor controlling the actuation of said silicon controlled rectifier.

16. In an electrical primary control and ignition system for oil burners, the combination including burner control means adapted to be connected to a main line source of AC current, a low voltage control circuit including burner ignition detection means, means providing a substantially lower voltage than line voltage in said control circuit, means in said low voltage control circuit including solid state means effective to actuate said burner control means, means interfacing between said low voltage control circuit and said burner control means, plasma generating means adapted to be connected to said main line source of AC current, and combustion initiation means operatively connected to said plasma generating means.

17. The combination as set forth in claim 16, said plasma generating means including a silicon controlled rectifier having an anode, a cathode and a gate, a transformer having a primary winding and a secondary winding, a capacitor, a diode and a resistor, said primary winding and said diode being connected in series with said anode and said cathode, said resistor being connected in parallel with said diode, said capacitor being connected in parallel with said anode and said cathode, and choke means electrically connected in series with said capacitor.

18. The combination as set forth in claim 17, said plasma generating means including trigger means and electronic brake means.

19. The combination as set forth in claim 18, said trigger means including a silicon controlled rectifier having an anode, a cathode and a gate, a pair of resistors, a diode, a capacitor and a trigger diode, one of said resistors, said diode, said capacitor and said trigger diode being connected across said anode and said cathode of said silicon controlled rectifier, the other of said resistors being connected to said gate.

20. The combination as set forth in claim 19, said electronic brake means comprising a pair of capacitors, a diode and a plurality of resistors, said diode, said resistors and one of said capacitors being connected in parallel with the other of said capacitors.

21. The combination as set forth in claim 20 wherein said burner control means includes a triac.

22. The combination as set forth in claim 22, said interfacing means including a reed switch having a pair of normally open contacts, said control circuit including a coil encompassing said contacts whereby energization of said coil effects closing of said contacts, said control circuit also including a DC supply for said coil.

23. The combination as set forth in claim 22, said combustion initiation means including a transformer having a primary winding and a secondary winding, and a pair of spaced electrodes electrically connected to said secondary winding.

24. The combination as set forth in claim 23, wherein said control circuit also includes energy conversion means effective to interrupt the flow of current from said main line source of AC current, said ignition detection means also being effective to disable said energy conversion means.

25. The combination as set forth in claim 24, including electrical switch means controlled by said energy conversion means and effective to interrupt the flow of current from said main line source of AC current.

26. The combination as set forth in claim 25, said ignition detection means being in the form of a light dependent resistor.

27. The combination as set forth in claim 26 including extended ignition means operatively connected to said plasma generating means and effective to maintain energization of said plasma generating means for a predetermined period of time as a function of ignition detected by said ignition detection means.

28. The combination as set forth in claim 27, said extended ignition means including a silicon controlled rectifier and a capacitor controlling the actuation of said silicon controlled rectifier.

29. In an ignition system for oil burners, the combination comprising ignition detection means, plasma generating means adapted to be connected to a main line source of AC current, combustion initiation means operatively connected to said plasma generating means, said plasma generating means including a silicon controlled rectifier having an anode, a cathode and a gate, a transformer having a primary winding and a secondary winding, a capacitor, a diode and a resistor, said primary winding and said diode being connected in series with said anode and said cathode, said resistor being connected in parallel with said diode, said capacitor being connected in parallel with said anode and said cathode, and extended ignition means operatively connected to said plasma generating means and effective to maintain energization of said plasma generating means for a predetermined period of time as a function of ignition detected by said ignition detection means.

30. The combination as set forth in claim 29, said plasma generating means including trigger means and electronic brake means.

31. The combination as set forth in claim 30, said trigger means including a silicon controlled rectifier having an anode, a cathode and a gate, a pair of resistors, a diode, a capacitor and a trigger diode, one of said resistors, said diode, said capacitor and said trigger diode being connected across said anode and said cathode of said silicon controlled rectifier, the other of said resistors being connected to said gate.

32. The combination as set forth in claim 30, said electronic brake means comprising a pair of capacitors, a diode and a plurality of resistors, said diode, said resistors and one of said capacitors being connected in parallel with the other of said capacitors.

33. The combination as set forth in claim 29, and combustion initiation means including said secondary winding, and a pair of spaced electrodes electrically connected to said secondary winding.

34. The combination as set forth in claim 29, including choke means electrically connected in series with said capacitor.

35. In an ignition system for oil burners, the combination comprising ignition detection means, plasma generating means adapted to be connected to a main line source of AC current, combustion initiation means controlled by said plasma generating means, said plasma generating means including a silicon controlled rectifier having an anode, a cathode and a gate, a transformer having a primary winding and a secondary winding, a capacitor, a diode and a resistor, said primary winding and said diode being connected in series with said anode and said cathode, said resistor being connected in parallel with said diode, said capacitor being connected in parallel with said anode and said cathode, said plasma generating means also including trigger means and electronic brake means, and extended ignition means operatively connected to said plasma generating means and effective to maintain energization of said plasma generating means for a predetermined period of time as a function of ignition detected by said ignition detection means.

36. The combination as set forth in claim 35, said trigger means including a silicon controlled rectifier having an anode, a cathode and a gate, a pair of resistors, a diode, a capacitor and a trigger diode, one of said resistors, said diode, said capacitor and said trigger diode being connected across said anode and said cathode of said silicon controlled rectifier, the other of said resistors being connected to said gate.

37. The combination as set forth in claim 36, said electronic brake means comprising a pair of capacitors, a diode and a plurality of resistors, said diode, said resistors and one of said capacitors being connected in parallel with the other of said capacitors.

38. The combination as set forth in claim 37, and combustion initiation means including said secondary winding, and a pair of spaced electrodes electrically connected to said secondary winding.

39. The combination as set forth in claim 38, said extended ignition means including a silicon controlled rectifier and a capacitor controlling the actuation of said silicon controlled rectifier.

40. The combination as set forth in claim 38, said extended ignition means including a silicon controlled rectifier having an anode, a cathode and a gate, a resistor connected in series with said cathode, a plurality of diodes and a capacitor connected in parallel with said resistor, said capacitor being connected to said gate.

* * * * *